US006302621B1

(12) United States Patent
Miya et al.

(10) Patent No.: US 6,302,621 B1
(45) Date of Patent: Oct. 16, 2001

(54) SEGMENT FOR INTAKE TUNNELS

(75) Inventors: Kiyoshi Miya; Yoshihiro Tanaka, both of Tokyo (JP)

(73) Assignee: Obayashi Corporation, Osaka (JP)

( * ) Notice: Subject to any disclaimer, the term of this patent is extended or adjusted under 35 U.S.C. 154(b) by 0 days.

(21) Appl. No.: 09/147,624

(22) PCT Filed: Aug. 6, 1998

(86) PCT No.: PCT/JP98/03504

§ 371 Date: Feb. 3, 1999

§ 102(e) Date: Feb. 3, 1999

(87) PCT Pub. No.: WO99/09298

PCT Pub. Date: Feb. 25, 1999

(30) Foreign Application Priority Data

Aug. 13, 1997 (JP) ..... 9-218494
Aug. 13, 1997 (JP) ..... 9-218495
Nov. 18, 1997 (JP) ..... 9-316850

(51) Int. Cl.[7] ..... E21D 11/00; E21D 9/06

(52) U.S. Cl. ..... 405/43; 405/127; 405/145; 405/146; 405/151

(58) Field of Search ..... 405/43, 45, 50, 405/53, 55, 134, 135, 145, 52, 80, 127, 151, 146

(56) References Cited

U.S. PATENT DOCUMENTS 3,440,822 * 4/1969 Hegler ..... 405/45
3,936,380 * 2/1976 Boske ..... 405/45
3,946,762 * 3/1976 Green ..... 406/45
4,006,599 * 2/1977 Hegler et al. ..... 405/49
4,182,580 * 1/1980 Hieda et al. ..... 405/43
4,182,581 * 1/1980 Uehara et al. ..... 405/43
4,386,873 * 6/1983 Messner et al. ..... 405/36
4,432,667 * 2/1984 Richardson ..... 405/143
4,558,970 * 12/1985 Tsuzuki ..... 405/153
4,639,165 * 1/1987 Flecknoe-Brown ..... 405/45
4,815,895 * 3/1989 Purssey et al. ..... 405/153
4,824,287 * 4/1989 Tracy ..... 405/36
4,863,313 * 9/1989 Yamamoto et al. ..... 405/146
4,909,665 * 3/1990 Caouette ..... 405/45
4,913,587 * 4/1990 Kumai et al. ..... 405/146
4,950,103 * 8/1990 Justice ..... 405/43
5,051,028 * 9/1991 Houck et al. ..... 405/45
5,100,258 * 3/1992 Van Wagoner ..... 405/45
5,332,334 * 7/1994 Wagner et al. ..... 405/153
5,466,092 * 11/1995 Semenza et al. ..... 405/45

FOREIGN PATENT DOCUMENTS 5-156900 6/1993 (JP) .
7-43656 9/1995 (JP) .

OTHER PUBLICATIONS

International Search Report.

* cited by examiner

*Primary Examiner*—H. Shackelford
*Assistant Examiner*—Gary S. Hartmann
(74) *Attorney, Agent, or Firm*—Nixon Peabody LLP; Thomas W. Cole

(57) ABSTRACT

A segment 20 has segment units 22 obtained by dividing a cylindrical body having an appointed length into four sections along the circumferential direction. The segment units 22 are provided with a segment body 22*a*, a porous concrete layer 22*b*, water intake pores 22*c*, and clogging members 22*d*. The segment body 20*a* is constructed of a cast iron plate or steel plate and has an inwardly recessed portion on its outer circumferential surface. The concrete layer 22*b* is a porous material having water permeability, and is filled and solidified in the inwardly recessed portion 201*a*. The water intake pores 22*c* are formed on the flat bottom of two recessed portions 201*a* so as to penetrate the bottom, and are provided in a plurality along the circumferential direction with an appointed interval. The clogging members 22*d* are detachably screwed to the water intake pores 22*c*, wherein they clog the respective water intake pores 22*c*, and if the clogging members are removed, the water intake pores 22*c* are made open to the outside.

5 Claims, 10 Drawing Sheets

SEGMENT FOR INTAKE TUNNELS

TECHNICAL FILED

The present invention relates to a segment for a water intake tunnel, and in particular to a segment which is used as a water intake pipe used for introducing seawater into a seawater treatment plant such as a plant for turning seawater into freshwater, and a power generation plant.

BACKGROUND OF THE ART

A plant for turning seawater into freshwater is constructed in the vicinity of a seashore in order to obtain drinking water on an island and a desert region where there is only a small amount of precipitation. Furthermore, seawater is, for example, prime water for a plant making salt. In this type of seawater treatment plant, it is necessary to introduce seawater into equipment for turning seawater into freshwater.

Furthermore, in a nuclear power generation plant, a great amount of cooling water is required. In a case where such a power generation plant is installed in the vicinity of a seashore, seawater is used for cooling, and seawater is introduced as in the abovementioned plant.

Therefore, conventionally, in such a seawater treatment plant and a power generation plant, seawater was taken in by a water intake structure shown in "FIG. 13" to FIGS. 13A and 13B and FIG. 14.

In the water intake structure illustrated in the same drawing, a water reservoir 1 is installed in the vicinity of a seashore, a water collecting portion 2 is installed on the sea bottom, and a water conveyance pipe 3 is used to connect the water reservoir 1 to the water collecting portion 2, wherein seawater taken into the water reservoir 1 is pumped up by a pump 4 and is distributed to various kinds of facilities.

A number of water intake pipes 5 protruding toward both sides of the water conveyance pipe 3 are provided at the water collecting portion 2. A number of through holes are provided on the respective water intake pipes 5, and a synthetic resin net or unwoven cloth is wound on the outer circumference thereof in order to prevent earth and sand from invading.

In such a water intake structure, usually, a water conveyance pipe 3 is buried by a driving method or a dig-sink method.

However, in such a conventional burying method of a water conveyance pipe 3, there existed the following shortcomings and problems in the technical aspects as described below.

That is, when burying a water conveyance pipe 3 by a driving method or a dig-sink method, various limitations in working exist, resulting from the surrounding vicinity of the place directly above the burying position of the water conveyance pipe 3 being exclusively occupied.

For example, in work carried out by the driving method in a sea, since seawater is to be shut out, this causes a hindrance in sea transportation and makes it necessary to guarantee fishery rights.

Therefore, the present inventors developed a method for constructing a water intake pipe by utilizing a shield tunnel in order to solve these shortcomings and problems. Since places directly above the water intake pipe are not exclusively occupied if a water intake pipe is constructed by a shield construction method, no problems such as ocean pollution, etc. will occur.

However, a segment used for a conventional shield construction method is, generally, constructed of a segment body 6 made of steel reinforced concrete as shown in FIG. 14, wherein a plurality of segment bodies 6 are circumferentially connected to each other and are assembled to be cylindrical, and the assembled cylindrical bodies are connected one after another in the lengthwise direction.

The respective segment bodies 6 are provided with back-filling pores 7 penetrated in the thickness direction thereof, into which a back-filling material is supplied, and the back-filling pores 7 are clogged by a detachable plug packing 8.

The segment bodies 6 are connected to each other in the axial direction by bolts and nuts 10 with a packing put therebetween in a joint box 9 secured at the ends in the lengthwise axial direction, and a sealing material 11 and a caulking material 12 are caused to intervene between the end faces of the segment bodies 6.

As the segments are assembled, the plug packing 8 is detached, and a back-filling material 13 is supplied through the back-filling pores 7 between the outer circumferential surface of the segment bodies 6 and the driven surface of the ground, wherein a secondary coating layer 14 is formed on the inner circumferential side of the segment bodies 6.

With the segments thus constructed, external water is prevented from invading by causing the sealing material 11 to intervene, and supplying the back-filling material 13 into the backside, and internal water is thus prevented from leaking outside. Principally, such segments are constructed so that a water stop function is secured. Therefore, such segments do not have the feature of a water intake pipe for intake of seawater, and such types of segments could not be used for intake of water as they are.

The present invention was developed in view of such shortcomings and problems, and it is therefore an object of the invention to provide a segment for a water intake tunnel having a feature suitable for intake of water.

DISCLOSURE OF THE INVENTION

The invention provides a segment for a water intake tunnel, which is cylindrically assembled on the interior side of the surface driven by a shield driving machine, which includes segment units which are obtained by dividing a cylindrical body of an appointed length into a plurality along the circumferential direction, wherein the abovementioned segment units are provided with a plurality of water intake pores communicatable with the outside, and clogging members detachably attached to the respective water intake pores.

In the segments thus constructed, by removing a clogging member attached to a water intake pore, the water intake pore is caused to communicate with the outside and seawater can be taken in through the water intake pore.

The abovementioned water intake pore can be covered with a filtering layer on its outside.

According to this construction, since the outside of the water intake pore is covered with a filtering layer, it is possible to prevent sand and other foreign matter from invading.

The abovementioned segment unit has a segment body constructed of steel plate or cast iron plate and the abovementioned filtering layer secured on the outer circumferential surface of the segment body, wherein it is possible to construct the abovementioned filtering layer of a porous material such as a communicatable foaming material, a porous concrete, etc.

According to the construction, the segment can be made lighter than that made of steel-reinforced concrete.

Furthermore, the invention provides a segment for a water intake tunnel, which is cylindrically assembled on the interior side of the surface driven by a shield driving machine, which includes segment units which are obtained by dividing a cylindrical body of an appointed length into a plurality along the circumferential direction, wherein the abovementioned segment units are provided with a number of water intake pores penetrated in the thickness direction thereof, and clogging members detachably attached to the respective water intake pores.

In the segments thus constructed, by removing the clogging members attached to the water intake pores, the water intake pores are made open to the outside, and seawater can be taken in through the open water intake pores.

In this case, a greater number of water intake pores are set than the number of conventional back-filling pores. By making the number of water intake pores greater than that of the back-filling pores, the segments thus constructed can become suitable as a water intake pipe.

The abovementioned water intake pores are covered with a filtering layer on their outer surface, and a porous material such as a continuous foaming material and a porous concrete, etc., can be filled up in the abovementioned water intake pores.

According to the construction, since the water intake pores are covered with a filtering layer, it is possible to prevent sand and foreign matter from invading.

Furthermore, the invention provides a segment for a water intake tunnel, which is cylindrically assembled on the interior side of the surface driven by a shield driving machine, which includes segment units which are obtained by dividing a cylindrical body of an appointed length into a plurality along the circumferential direction, wherein the abovementioned segment units are constructed of segment bodies connected to each other in the circumferential and axial directions, water intake pores secured on the segment bodies and clogged by clogging members which are detached after the water intake tunnel is constructed, and an arch-shaped or dome-shaped porous water permeating plate which covers the outside of the abovementioned water intake pores, and a water permeating layer secured outside the abovementioned porous water permeating plate.

According to the segments for a water intake tunnel thus constructed, since the arch-shaped or dome-shaped porous water permeating plate which covers the outside of water intake pores is provided, and a water permeating layer is secured outward thereof, the arch-shaped or dome-shapedporous water permeating plate stands against external pressure when the external pressure operates on the water permeating layer, wherein no shearing force acts on the water permeating layer.

Furthermore, although the strength of the arch-shaped or dome-shaped porous water permeating plate is weakened by providing pores, the water permeating plate is made advantageous in view of the external pressure by an arch effect or a dome effect, wherein the thickness of the porous water permeating plate can be made thinner than that of a flat plate.

The abovementioned porous water permeating plate may be selected among a metal plate, stainless steel plate onto which rust-preventive treatment of appointed thickness is given, or plastic plate, etc. According to the construction, the permeability of the water permeating plate is not spoiled by rust, and it may be used in a longer period of time.

The abovementioned water permeating layer may be selected among a communicatable foaming member, a porous concrete, etc., which are filled up in recesses formed on the abovementioned segment bodies.

BEST MODE FOR CARRYING OUT THE INVENTION

Figure 1:
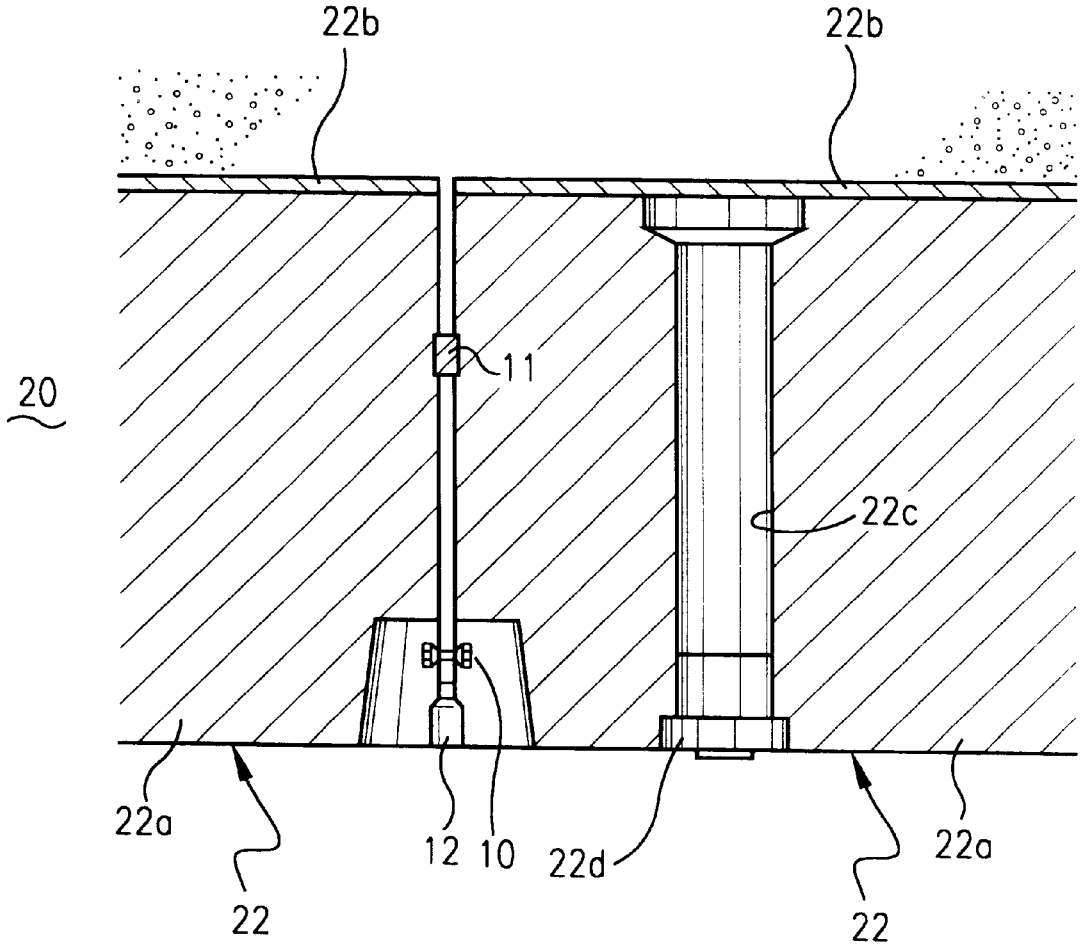
FIG. 1 is a perspective view showing, in an assembled state, a first preferred embodiment of a segment for a water intake tunnel according to the invention.

Hereinafter, a detailed description is given of the preferred embodiments of the invention with reference to the accompanying drawings. FIG. 1 shows the first preferred embodiment of a segment for a water intake tunnel according to the invention.

Segments 20 illustrated in these drawings are cylindrically assembled on the interior surface of the side driven by a shield driving machine by tightening bolts and nuts, and have segment units 22 which are obtained by dividing a cylindrical body of an appointed length into a plurality along the circumferential direction.

FIG. 1 shows a sectional view of major parts of such segment units 22 in an assembled state. As in the conventional steel-reinforced concrete segments, the segment units 22 are cylindrically assembled by connecting those adjacent to each other in the circumferential and lengthwise directions with bolts and nuts, wherein a sealing material 11 and a caulking material 12 are caused to intervene between the end portions adjacent to each other in the lengthwise direction.

The respective segment units 22 are provided with a segment body 22*a*, a filter layer 22*b*, a water intake pore 22*c*, and a clogging member 22*d*. A segment 20*a* is made of steel reinforced concrete, wherein unwoven fabric and resin net or a filter layer 22*b* in which these are combined are adhered to the entire outer circumferential surface.

The water intake pores 22*c* are provided so as to penetrate the segment body 22*a* in its thickness direction, and the number thereof is made greater than that of the conventional back-filling pores. In this case, the water intake pores 22*c* may be constructed so that the back-filling pores secured on the conventional segments are utilized as water intake pores as they are, and other separate pores are provided in a plurality in addition thereto.

Furthermore, the cross-sectional shape of the water intake pores 22*c* may have the same diameter at any point and be circular, and they may be formed so as to be, for example, funnel-like, the diameter of which gradually expands outwardly.

The clogging members 22*d* are detachably fixed on the water intake pores 22*c* and clog the water intake pores 22*c*, and at the same time, if the clogging members 22*d* are removed, the water intake pores 22*c* may be made open to the outside.

Figure 2:
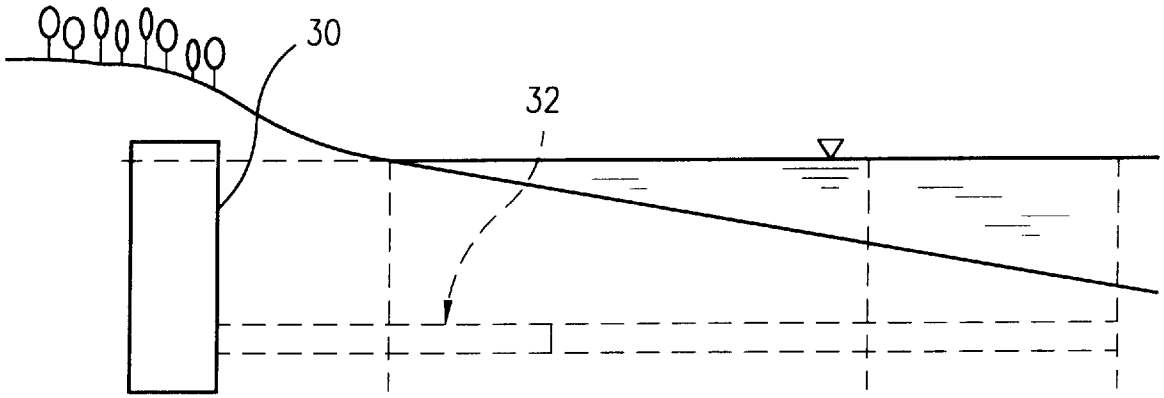
FIG 2 is a sectional view of major parts of the first embodiment shown in FIG. 1.

FIG. 2 through FIG. 5 show a method for constructing a water intake tunnel using the segments 20 disclosed by the preferred embodiment. In the method for constructing a water intake tunnel illustrated in these drawings, first, as shown in FIG. 2, a vertical shaft 30 is constructed in the vicinity of a seashore where a seawater treatment plant such as a plant for turning seawater into freshwater and a power generation plant (not illustrated) is constructed.

The vertical shaft 30 may be constructed to an appointed depth by already known methods such as reverse-winding method and a continuous underground wall construction method. After the construction is completed, it functions as a reservoir of the taken in seawater.

As the vertical shaft 30 is constructed, an already known shield driving machine (not illustrated) is installed on the bottom of the vertical shaft, and the shield driving machine is advanced toward to the seashore, breaking the wall of the vertical shaft 30, wherein a water intake tunnel 32 is constructed as shown with a dashed line in FIG. 2.

The water intake tunnel 32 becomes a water intake pipe after construction is completed, and is constructed by annularly assembling segments one after another at the rear side of the shield driving machine.

This type of water intake tunnel 32 is caused to linearly extend from the vertical shaft 30 toward the seashore side. The tip end thereof reaches below the sea bottom at an appointed depth, and is located below the sea bottom.

After the construction of such a water intake tunnel 32 is completed, the shield driving machine is left over and buried at the tip end portion of the tunnel as it is, and a tip end bulkhead 36 is secured at the tip end of the water intake tunnel 32.

Figure 3:
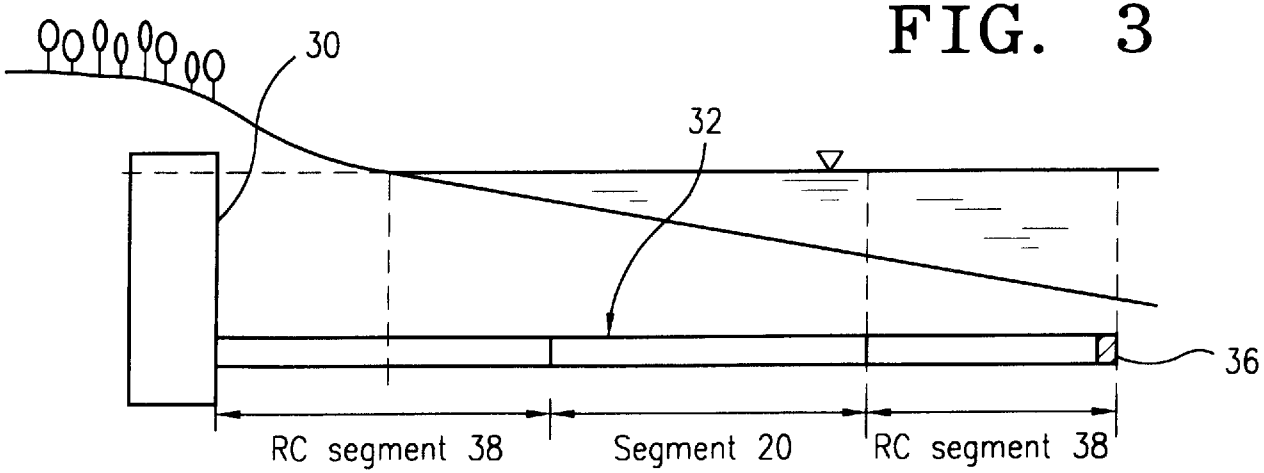
FIG. 3 is an explanatory view of the first process for constructing a water intake tunnel using the segments according to the invention.

Furthermore, two types of segments are used for the water intake tunnel 32 of this example, one of which is a steel-reinforced concrete type RC segment 38, and the other of which is a segment 20 of the preferred embodiment as shown in FIG. 3.

The RC segment 38 is used at the vertical shaft 30 side and the tip end side of the water intake tunnel 32, and segments 20 according to the preferred embodiment are used between the RC segments 38.

The RC segments 38 are those used for a conventional shield construction method and are those which a cylindrical body of an appointed length is divided into a plurality along the circumferential direction. That is, portions adjacent to each other in the circumferential and lengthwise directions are connected to each other by bolts and nuts and are assembled to be annular. After the secondary coating work is finished, for example, an epoxy resin lining layer is formed for rust preventive purposes.

Figure 4:
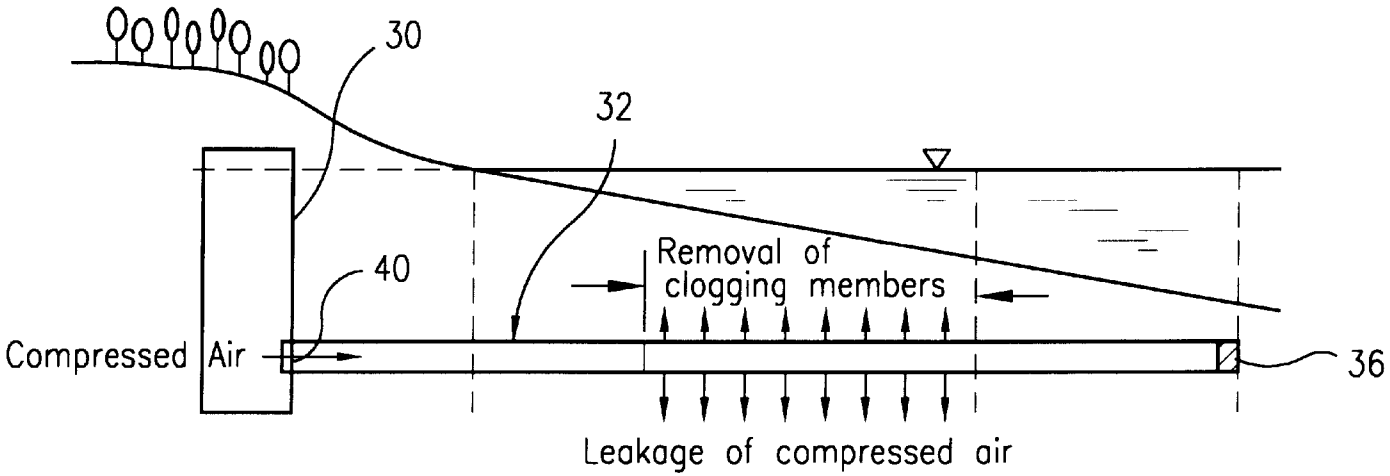
FIG. 4 is an explanatory view of the process which is performed next to the process shown in FIG. 3.
Figure 5:
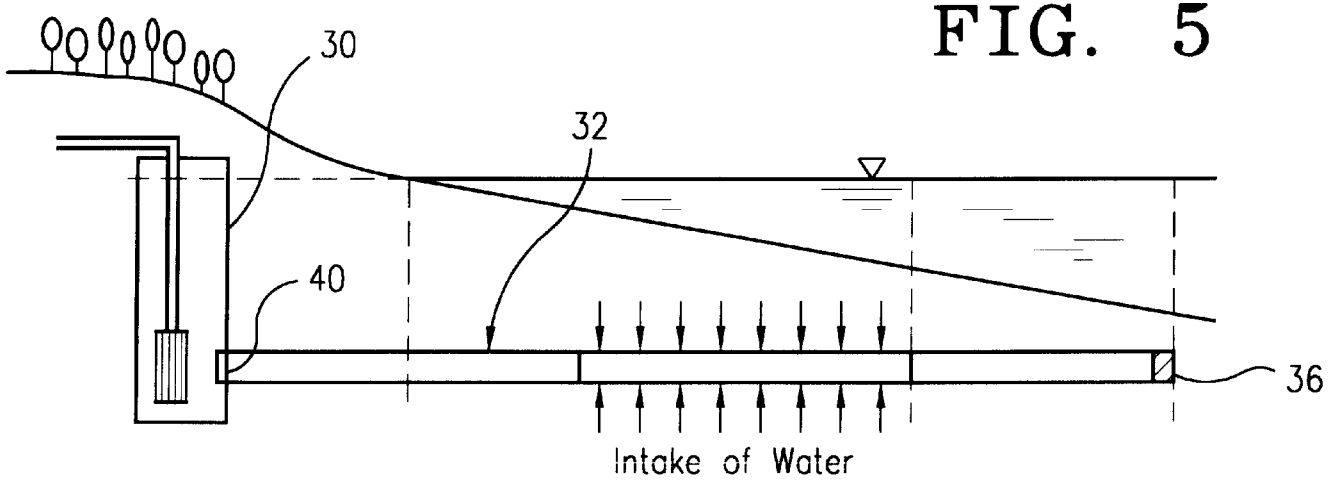
FIG. 5 is an explanatory view of the process which is performed next to the process shown in FIG. 4.

After the water intake tunnel 32 is constructed, as shown in FIG. 4, a bulkhead 40 is provided at the starting side of the water intake tunnel 32, and compressed air is introduced into the water intake tunnel 32, wherein workmen enter the water intake tunnel 32 to remove the clogging members 22*d* of the segments 20.

In this case, since compressed air is introduced into the water intake tunnel 32, seawater can be prevented from invading through the water intake pores 22*c* even though the clogging members 22*d* are removed, and at the same time the compressed air introduced into the tunnel 32 passes through the water intake 22*c* and filter layer 22*b* and leaks outwardly. Therefore, the water intake pores can be prevented from being clogged.

After all the clogging members 22*d* of the segments 20 are removed, the compressed air pressure is gradually decreased so that seawater does not rush into the water intake tunnel 32, and seawater is taken in the tunnel 32 through the water intake pores 22*c*.

At the same time, seawater is taken into the vertical shaft 30 which will become a reservoir, wherein after the water level in the vertical shaft 30 reaches the same level as that of the sea, the bulkhead 40 at the starting side of the tunnel is released. As such an operation is finished, the construction of a water intake pipe constructed of a water intake tunnel 12 is completed.

As a water intake pipe is thus completed, since the water intake tunnel 32 which becomes a water intake pipe can be constructed from the vertical shaft 30 without exclusively occupying the places directly above the tunnel, no problem such as a hindrance in sea transportation, fishery rights guarantees, and ocean pollution, etc. occurs.

In a case where the segments 20 according to the preferred embodiments are used for such a constructing method, they are given a water intake function by removing the clogging members 22*d* after the water intake tunnel 32 is constructed.

In this case, since the segments 20 according to the preferred embodiment are such that a plurality of water intake pores 22*c*, the structure of which is similar to that of back-filling pores, are added to the RC segments 38, conventional RC segments may be utilized while maintaining the basic structure thereof without greatly changing their design.

Furthermore, since a filter layer 22*b* is provided on the segments 20 so that it covers the outside of the water intake pores 22*c*, it is possible to prevent sand and foreign matter from invading.

Figure 6:
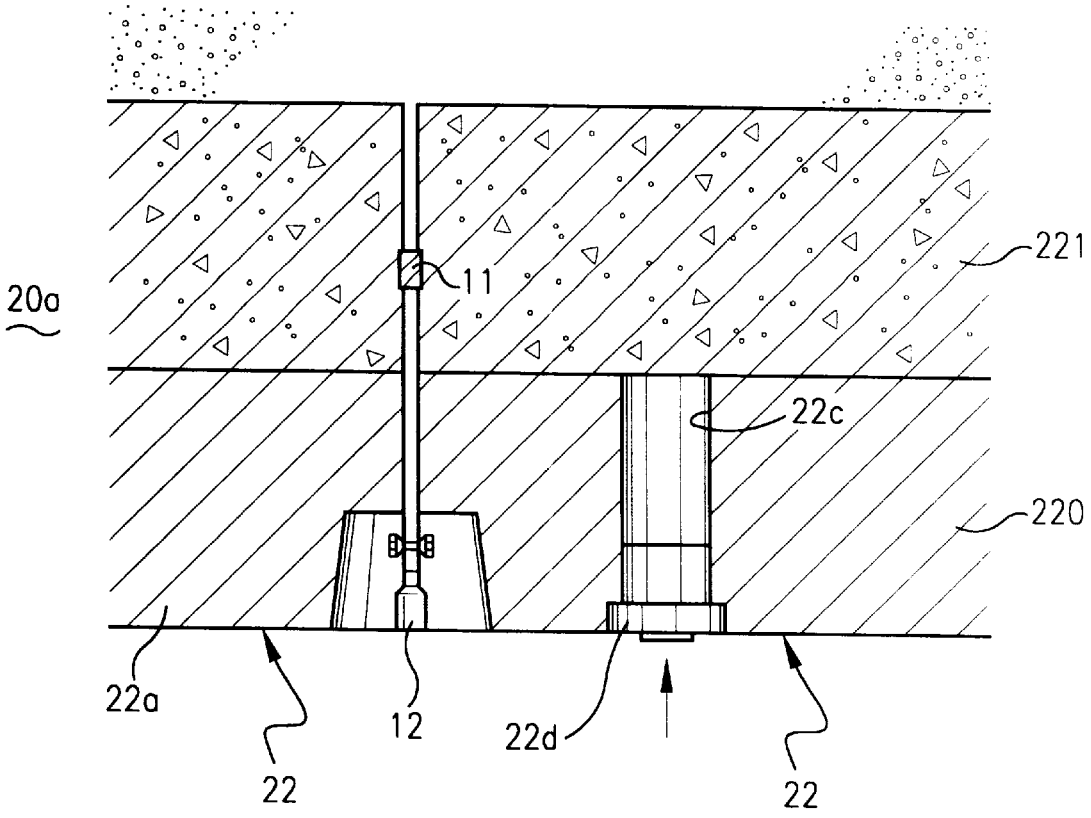
FIG. 6 is a sectional view of major parts, which shows a second preferred embodiment of a segment for a water intake tunnel according to the invention.

FIG. 6 shows the second preferred embodiment of segments according to the invention. The parts which are identical to or correspond to those in the abovementioned first preferred embodiment are given the same reference numbers, and the description thereof is omitted, excepting that only the features thereof are described below.

The segments 20*a* illustrated in the same drawing are composed of an RC portion 220 at the inner circumferential side and a porous concrete portion 221 formed at the outer circumferential side thereof by dividing the body 22*a* of the respective segment units 22 into two layers.

The porous concrete portion 221 is a porous material having water permeability, and this may be substituted by a continuous foaming member. The water intake pores 22*c* are formed so as to penetrate only the RC portion 220.

If a water intake tunnel 32 is constructed by using the segments 20*a* thus constructed, actions and effects which are similar to those of the abovementioned first preferred embodiment can be obtained, and at the same time, in this preferred embodiment, the following effects can be also obtained.

That is, in the case of this preferred embodiment, since the segment bodies 22*a* are constructed of an RC portion 220 and a porous concrete portion 221, the entire weight of the segments 20*a* can be made lighter than that of the others.

Since, in the segments 20*a* according to the preferred embodiment, a porous concrete portion 221 is provided on the entire outer circumference, it is possible to collect seawater from the entire surface of this portion, the water collecting area can be expanded, and the water collecting quantity can be greatly increased. At the same time, since the velocity of seawater flowing toward the water intake pore 22*c* side is made slower on the surface side, there is an advantage by which the water intake pores are scarcely clogged.

Figure 7:
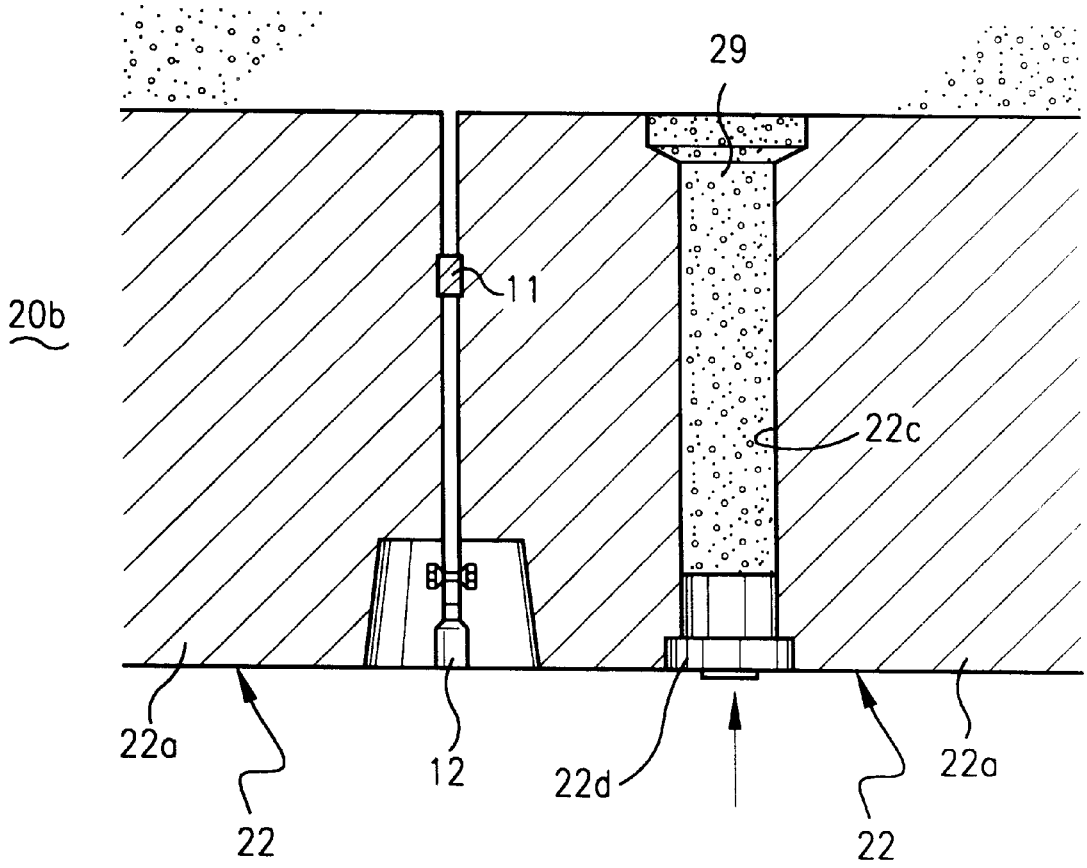
FIG. 7 is a sectional view of major parts, which shows a third preferred embodiment of a segment for a water intake tunnel according to the invention.

FIG. 7 shows the third preferred embodiment of a segment according to the invention. The parts which are identical to and similar to those in the abovementioned preferred embodiments are given the same reference numbers, the description of which is omitted, excepting that only the features thereof are described below.

In the segments 20*b* illustrated in the same drawing, a porous material 29 such as porous concrete is filled up, in advance, in a water intake pore 22*c* secured at the segment units 22*a*.

Even by the segments 20*c* thus constructed, actions and effects which are equivalent to those in the abovementioned first preferred embodiment can be obtained.

Figure 8:
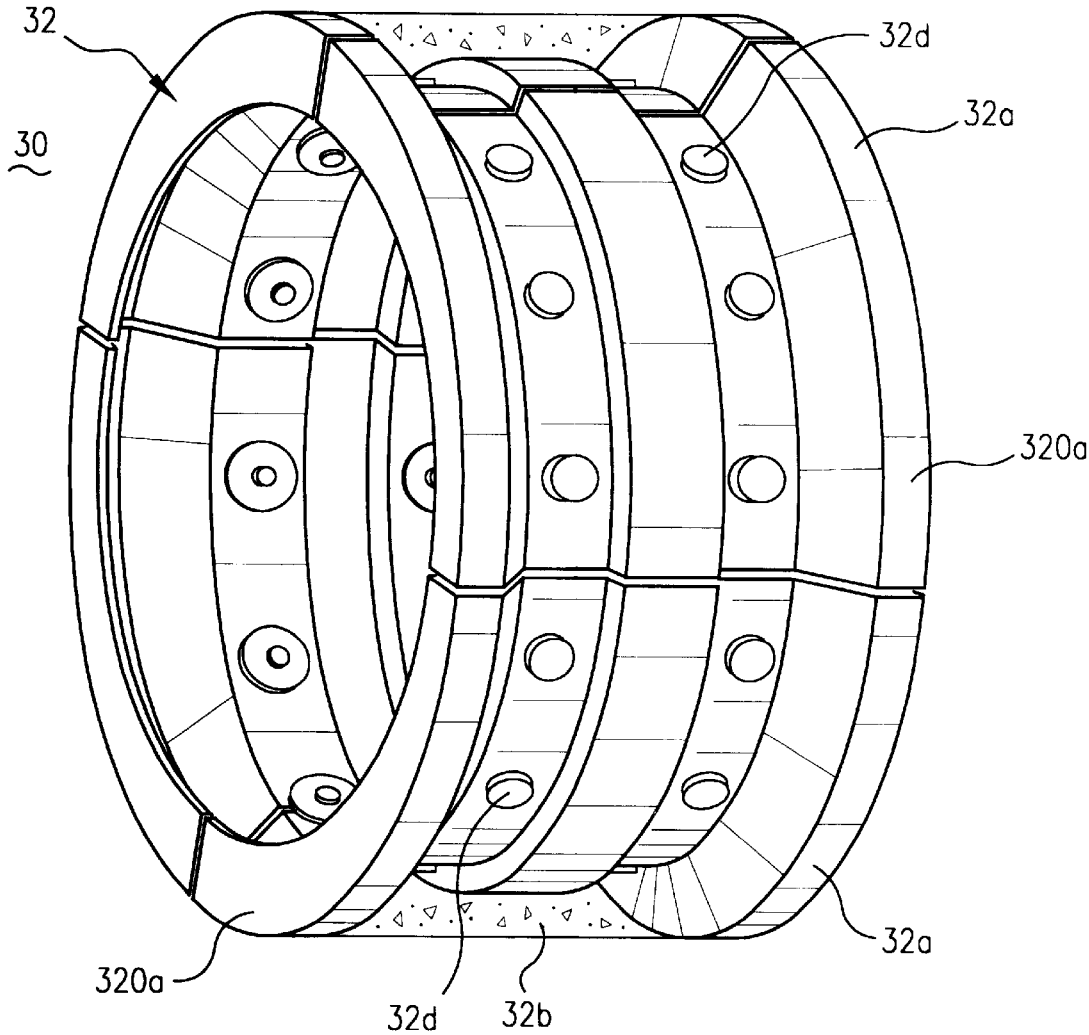
FIG. 8 is a perspective view showing, in an assembled state, a fourth preferred embodiment of a segment for a water intake tunnel according to the invention.
Figure 9:
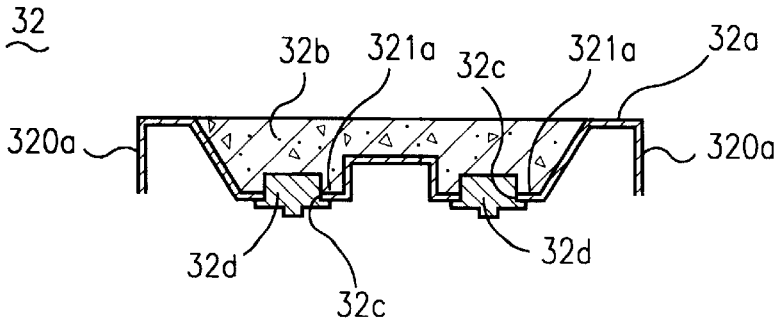
FIG. 9 is a sectional view of major parts shown in FIG. 8.

FIG. 8 and FIG. 9 show the fourth preferred embodiment of a segment for a water intake tunnel according to the invention.

Segments 30 illustrated in these drawings are those which are annularly assembled, by tightening bolts and nuts, on the interior of the side driven by a shield driving machine as in the abovementioned preferred embodiments, wherein as FIG. 8 shows an assembled state thereof, they have segment units 32 which are obtained by dividing a cylindrical body of an appointed length into four sections along the circumferential direction.

Segment units 32 are annularly assembled by connecting those adjacent to each other in the circumferential and lengthwise directions with bolts and nuts as in the conventional steel-reinforced concrete segments, and a sealing material and a caulking material are caused to intervene between the end portions thereof adjacent to each other in the lengthwise direction.

The respective segment units 32 are provided with a segment body 32*a*, a porous concrete layer 32*b*, a water intake pore 32*c*, and a clogging member 32*d*. The segment body 32*a* is composed of a cast iron plate or a steel plate. A pair of connection flanges are provided at both ends in the lengthwise direction, and two inwardly recessed portions 321*a* are connected to and formed at the outer circumferential surface between the flanges 320*a*.

The porous concrete layer 32*b* has a number of continuous gaps formed, and is a porous material having water permeability. The porous concrete layer 32*b* is filled and solidified in the recessed portions 321*a*. The water intake pores 32*c* are formed on a flat bottom surface of the two recessed portions 321*a* so as to penetrate the flat bottom, and they are provided in a plurality with an appointed interval along the circumferential direction. The respective water intake pores 32*c* are formed so as to communicate with the outside through the porous concrete layer 32*b*.

The clogging members 32*d* are detachably screwed to the water intake pores 32*c* and clog the water intake pores 32*c*. If the clogging members 32*d* are removed, the water intake pores 32*c* are caused to communicate with the outside via the porous concrete layer 32*b*.

Furthermore, in the segments 30 according to this preferred embodiment, a filter material such as unwoven cloth, etc., may be adhered to the entirety of the outer circumferential surface of the porous concrete layer 32*b*, and, for example, a continuous foaming material may be used instead of the porous concrete layer 32*b*.

The method illustrated in FIG. 2 through FIG. 5 may be employed as a method for constructing a water intake tunnel 32, using the segments 30 according to the preferred embodiment.

In the segments 30 according to the preferred embodiment, it is possible to give them a seawater intake function by removing the clogging members 32*d* after the water intake tunnel 32 illustrated in FIG. 2 through FIG. 5 is constructed.

Furthermore, since a porous concrete layer 32*b* is provided on the upper side of the water intake pores 32*c* at the segments 30, the porous concrete layer 32*b* functions as a filter, and it is possible to prevent sand and foreign matter from invading.

Furthermore, in the preferred embodiment, the segment units 32 are constructed of a segment body 32*a* made of a steel plate or a cast iron plate, and a porous concrete layer 32*b* formed on the outer circumferential surface of the segment body 32*a* integral therewith. Therefore, it is possible to lighten the weight of the segments 30.

Furthermore, since, in the segments 30 according to the preferred embodiment, a porous concrete layer 32*b* is secured on the entire outer circumferential surface, it is possible to collect seawater from the entirety of this portion, and the water collecting area can be expanded, wherein the water collecting quantity can be greatly increased. At the same time, since the velocity of seawater flowing toward the water intake pore 32*c* side is made slower on the surface side, there is an advantage in which the water intake pores are scarcely clogged.

Figure 10:
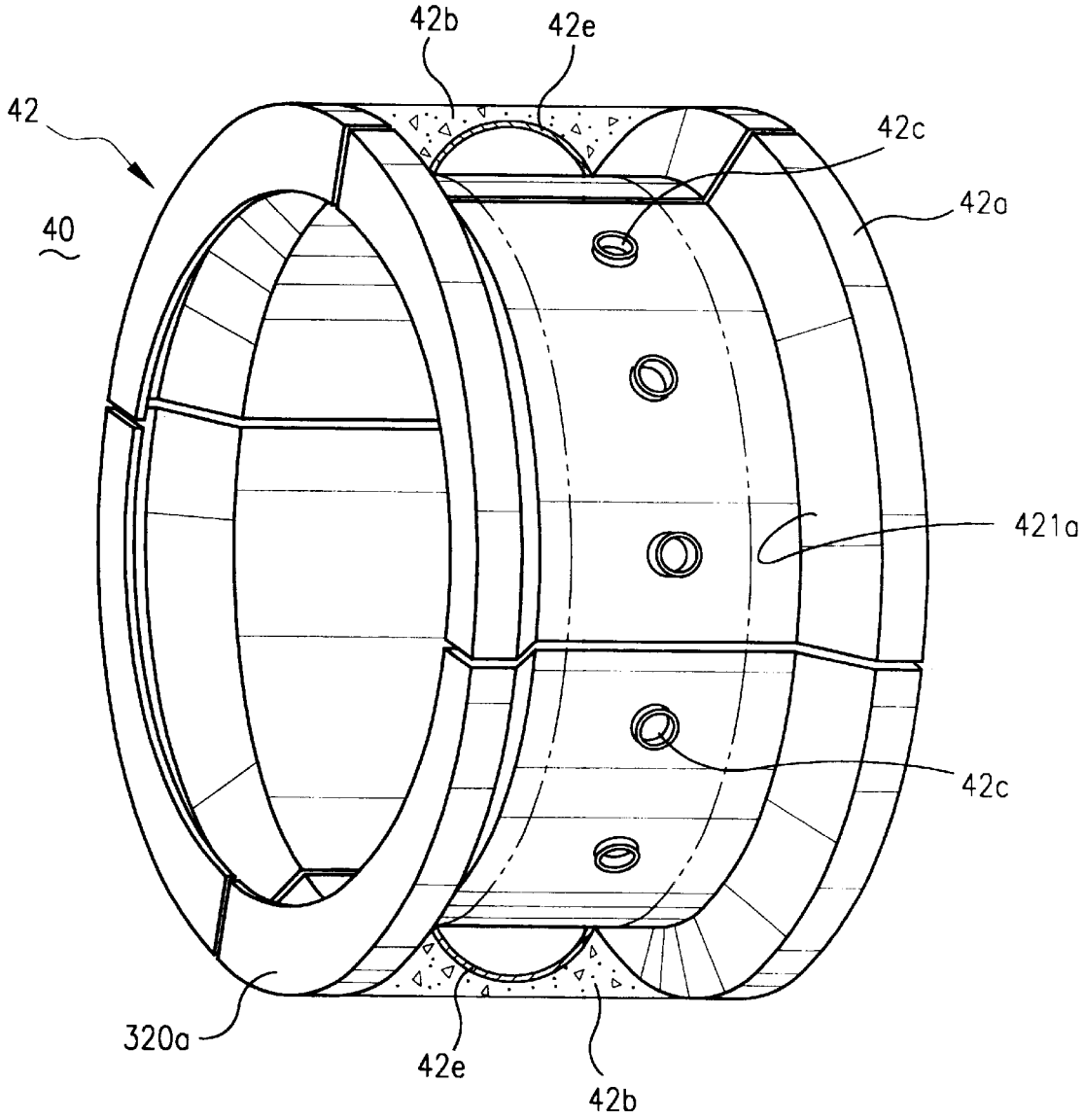
FIG. 10 is a perspective view showing, in an assembled state, a fifth preferred embodiment of a segment for a water intake tunnel according to the invention.
Figure 11:
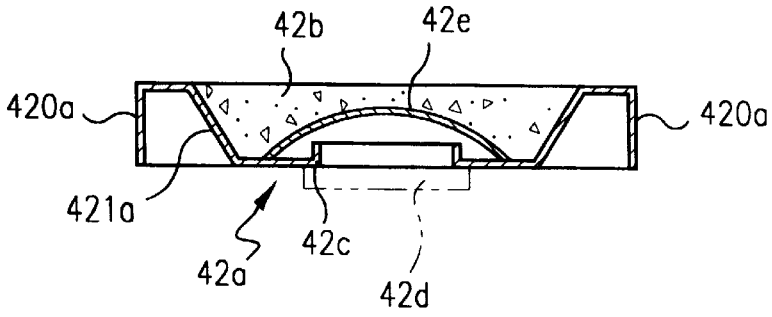
FIG. 11 is a sectional view of major parts shown in FIG. 10.

FIG. 10 and FIG. 11 show the fifth preferred embodiment of a water intake tunnel segment according to the invention.

Segments 40 illustrated in the same drawings are those which are annularly assembled on the interior of the side driven by a shield driving machine by tightening bolts and nuts as in each of the abovementioned preferred embodiments, and as the assembled state thereof is illustrated in FIG. 10, they have four segment units 42 which are obtained by dividing a cylindrical body of an appointed length into four sections along the circumferential direction.

The segment units 42 adjacent to each other in the circumferential and lengthwise directions are annularly assembled by bolts and nuts as in segments used in the conventional shield construction method, wherein a sealing material and a caulking material (not illustrated herein) are caused to intervene between the respective joint portions.

The respective segment units 42 are provided with a segment body 42*a*, a water permeating layer 42*b*, a water intake pore 42*c*, a clogging member 42*d*, and porous water permeating plate 42*e*.

The segment body 42*a* is constructed of a cast iron plate or a steel plate, and a pair of connection flanges 420*a* are provided at both ends in the lengthwise direction, an inwardly recessed portion 421*a* is formed on the outer circumferential surface between the flanges 420*a*.

The water intake pores 42*c* are located on the center line of the recessed portion 421*a* and are formed on the flat bottom so as to penetrate the bottom thereof. And they are provided in a plurality with an appointed interval along the circumferential direction. In the case of this preferred embodiment, through holes are made at the segment body 42*a* as water intake pores, and the periphery thereof is caused to protrude outwardly, wherein the water intake pores are formed integral with the segment body 42*a*.

The clogging members 42*d* are detachably screwed to the water intake pores 42*c*, wherein during the construction of a water intake tunnel, the water intake pores 42*c* are clogged by these clogging members 42*d*, and after the water intake tunnel is constructed, the water intake pores are made open by removing the clogging members 42*d*.

The porous water permeating plate 42*e* is provided so as to cover the outside of the water intake pores 42. In this preferred embodiment, the cross-section thereof is made semi-circularly arch-shaped, wherein space is formed above the outer circumference of the water intake pores 42*c*.

Furthermore, a number of through holes (not illustrated) are drilled in the porous water permeating plate 42*e* in the thickness direction, thereby water permeability is given thereto.

Furthermore, in this preferred embodiment, the porous water permeating plate 42*e* is formed so as to cover the outer circumference of a segment 40 when the segment 40 is cylindrically assembled. The porous water permeating plate 42*e* is constructed of, for example, a metal plate, a stainless steel plate, to which a rust preventive treatment of an appointed thickness is given, and plastic plate, etc.

In a case where the abovementioned metal plate or stainless steel plate is used as the porous water permeating plate 42*e*, they may be fixed to the outer circumference of the recessed portion 421*a* of the segment body 42*a* by welding, and if a plastic plate is used, it may be adhered thereto by an adhesive agent.

With the porous water permeating plate 42*e* for which the abovementioned plate material is used, since clogging resulting from rust can be prevented from occurring, the water permeability of the water permeating plate 42*e* is not eliminated.

Therefore, its lifetime usefulness may be extended.

The water permeating layer 42*b* us a porous material having water permeability, which has a number of continuous openings formed, and is selected among, for example, a continuous foaming material or porous concrete, etc. The water permeating layer 42*b* is filled up and fixed in the outwardly recessed portion 421*a* of the porous water permeating plate 42*e*.

Furthermore, in the segments 40 according to the preferred embodiment, a filter material such as unwoven cloth may be adhered to the entire outer circumferential surface of the water permeating layer 42*b*.

Furthermore, according to the segments 40 thus constructed, since an arch-shaped porous water permeating plate 42*e* which covers the outside of the water intake pores 42*c* is provided, and a water permeating layer 42*b* is provided outward thereof, the arch-shaped porous water permeating plate 42*e* can stand up against external pressure when the external pressure operates on the water permeating layer 42*b*, wherein the shearing strength of the water permeating layer 42*b* can be increased.

Therefore, in the segments 40 of the preferred embodiment, the number of pores in the material can be increased without sacrificing the water permeability of the water permeating layer 42*b*, and the pore diameter can also be increased. Therefore, it is possible to increase the permeability.

Still furthermore, although the strength of the arch-shaped porous water permeating plate 42*e* is decreased since pores are provided, it becomes more advantageous in view of the external pressure from the arch effect, wherein it is possible to further reduce the thickness of the materials than that of a flat material, and since the thickness of the water permeating layer 42*b* is decreased, the entire weight thereof can be decreased.

Figure 12:
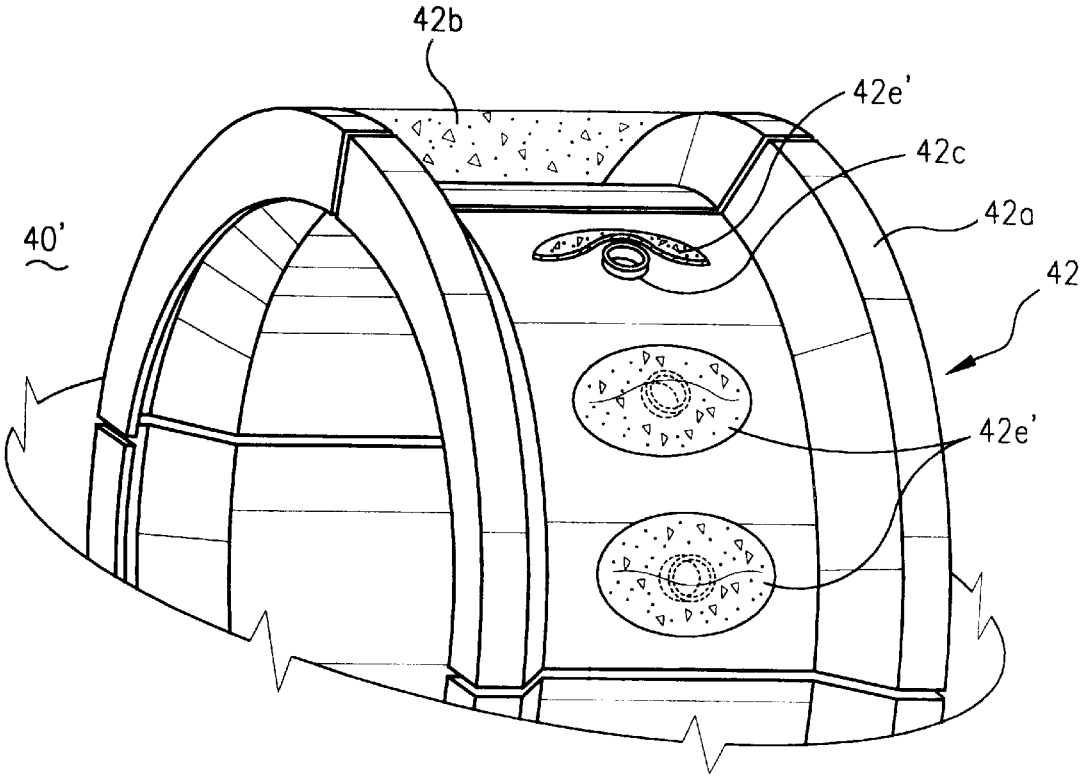
FIG. 12 is a perspective view showing, in an assembled state, a sixth preferred embodiment of a segment for a water intake tunnel according to the invention.
Figure 13A:
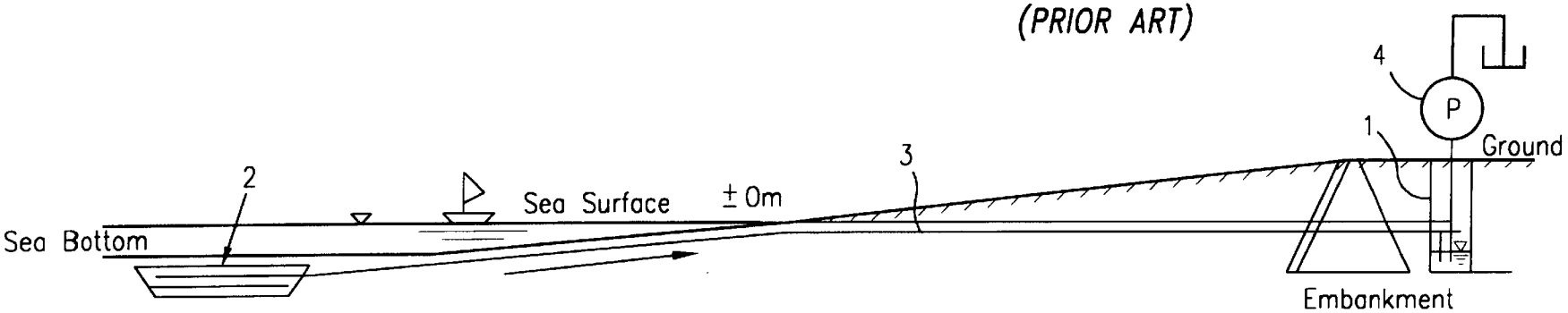
FIG. 13A (PRIOR ART)
FIGS. 13A and 13B are explanatory views showing one example of a conventional water intake structure.
Figure 13B:
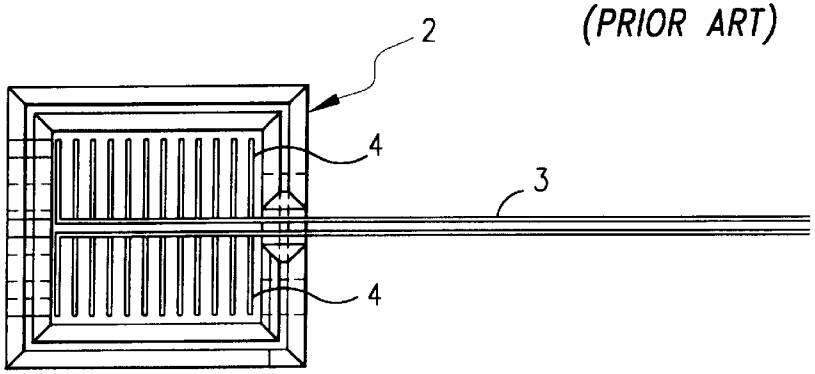
FIG. 13B (PRIOR ART)
Figure 14:
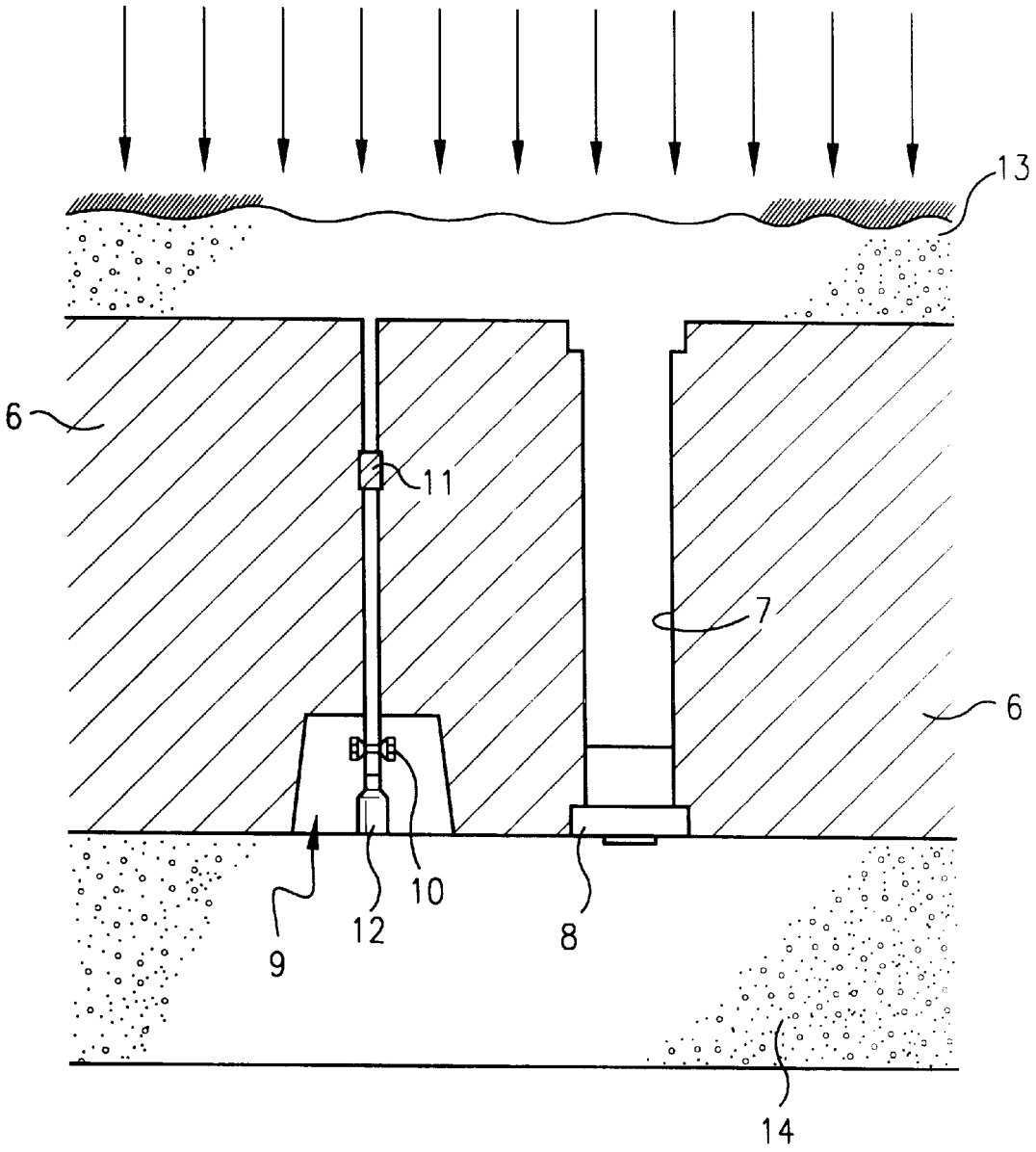
FIG. 14 (PRIOR ART)
FIG. 14 is a sectional view showing one example of the conventional segments.

FIG. 12 is the sixth preferred embodiment of a water intake tunnel segment according to the invention. The parts which are identical to or equivalent to those in the abovementioned preferred embodiments are given the same reference numbers, the description of which is omitted, excepting that only the features thereof are described below.

In the preferred embodiment illustrated in the same drawing, the porous water permeating plate 42*e*' is formed to dome-shaped, wherein the outside of the water intake pores 42*c* are individually enclosed by the dome-shaped porous water permeating plate 42*e*'.

Even with the segments 40' thus constructed, since a water permeating layer 42*b* is provided outward of the dome-shaped porous water permeating plate 42*e*', actions and effects which are similar to those of the abovementioned fifth preferred embodiment can be achieved.

Furthermore, a water intake tunnel 32 for which segments according to the invention are employed can be used for not only intake of seawater, but also, for example, discharge or delivery of the remaining seawater having high salt concentration, which is treated for turning seawater into freshwater, and the warmed remaining water utilized for power generation, etc., toward the sea through the water intake tunnel 32.

INDUSTRIAL APPLICABILITY

A water intake tunnel segment according to the invention is effective and advantageous as a water intake pipe used to introduce seawater into a seawater treatment plant such as a plant for turning seawater into freshwater, and a power generation plant, etc.

What is claimed is:

1. An improved shield-assembled tunnel of the type assembled inside a surface driven by a shield driving machine, including a plurality of cylindrical segment units which are formed from a rigid material, wherein each of said segment units is provided with a plurality of water intake pores communicable with an outside, and clogging members detachably attached to the respective water intake pores, wherein the improvement comprises a filter layer means covering said water intake pores on an outer circumferential surface of said segment units for filtering water entering the tunnel; and wherein each of said segment units has a segment body made of a metal plate, and said filter layer means is secured on the outer circumferential surface of said segment body, and wherein said filter layer means is constructed of a porous solid material.

2. An improved shield-assembled tunnel of the type assembled inside a surface driven by a shield driving machine, including a plurality of cylindrical segment units which are formed from a rigid material, wherein each of said segment units is provided with a number of water intake pores passing through a thickness direction thereof, and a clogging member detachably attached to the respective water intake pores, wherein the improvement comprises a filter layer means covering said water intake pores on an outer circumferential surface of said segment units for filtering water entering the tunnel, said filter layer means being a porous material filling up said water intake pores comprising one of the group consisting of a communicatable foaming member and porous concrete.

3. An improved shield-assembled tunnel of the type assembled inside the surface driven by a shield driving machine, including:

a plurality of cylindrical segment units, which are formed from a rigid material, and are further provided with:

segment bodies connected to each other in circumferential and axial directions, and water intake pores secured at each of said segment bodies and clogged by a clogging member which is removable after a water intake tunnel is constructed, wherein the improvement comprises rounded porous water permeating plates for covering said water intake pores from an outside thereof, and a water permeating layer secured over each of said porous water permeating plates.

4. An improved shield-assembled tunnel as set forth in claim 3, wherein said porous water permeating plates are selected from one of the group consisting of a metal plate, a stainless steel plate having a rust-preventive layer, and a plastic plate.

5. An improved shield-assembled tunnel as set forth in claim 3, wherein said water permeating layer is composed of either a communicatable foaming member, or porous concrete.

* * * * *